United States Patent [19]

Amoroso

[11] 4,392,263

[45] Jul. 12, 1983

[54] PORTABLE RESCUE TOOL

[76] Inventor: Michael J. Amoroso, 210 N. Shoreland, Marion, Ill. 62959

[21] Appl. No.: 230,622

[22] Filed: Feb. 2, 1981

[51] Int. Cl.[3] ..... B25F 1/00

[52] U.S. Cl. ..... 7/100; 30/134; 81/3 K; 72/464; 29/566.1

[58] Field of Search ..... 29/566.1, 239; 30/228, 30/134, 123, 124; 7/100; 83/601; 81/3 K; 72/463, 464

[56] References Cited

U.S. PATENT DOCUMENTS

| | | | |
|---|---|---|---|
| 2,296,173 | 9/1942 | Mandl | 72/392 |
| 3,577,881 | 5/1971 | Markovics | 72/392 |
| 3,819,153 | 6/1974 | Hurst | 29/252 X |
| 3,834,434 | 9/1974 | Walsh | 30/228 |
| 3,837,076 | 9/1974 | Good | 30/228 X |
| 3,891,187 | 6/1975 | Bearden | 254/93 R |
| 3,972,097 | 8/1976 | Schakat | 30/228 |

FOREIGN PATENT DOCUMENTS 2621249 11/1977 Fed. Rep. of Germany ..... 81/3 K

*Primary Examiner*—Jimmy C. Peters
*Attorney, Agent, or Firm*—Cohn, Powell & Hind

[57] ABSTRACT

This rescue tool includes a body, providing a cylinder and a piston extending outwardly of the cylinder, and a pair of jaw members pivotally connected to the body by link members and the piston. The jaw members include cooperating outer prying portions, inner cutting portions and intermediate shearing portions. The cutting and shearing portions include arcuate edges defining overlapping points and the prying portions are thickened to facilitate wedge action. The tool can be powered by a bi-directional motor, reservoir and battery system or can be powered directly from a wrecker motor vehicle system.

22 Claims, 15 Drawing Figures

10
V2
MAN
RESERVOIR
PUMP
MOTOR
81

10
81
V3
SOL
SOL
FROM TRUCK
TRUCK RESERVOIR 10
81
V1
SOL
SOL
RESERVOIR
PUMP
MOTOR

PORTABLE RESCUE TOOL

BACKGROUND OF THE INVENTION

This tool relates generally to a rescue tool and particularly to a prying and cutting tool used to free occupants trapped in an automobile wreckage.

There are several tools available which are intended for the purpose of freeing occupants of wrecked motor vehicles. These tools suffer from considerable disadvantages. One serious disadvantage is that in many instances separate components are used for the prying and cutting actions. In consequence, it is necessary to waste valuable time converting from one mode to the other, even when quick disconnect hoses are used.

Rescue tools are frequently structured to provide a jaw opening in excess of twenty four inches (24"). A jaw opening of this extent results in a large tool having a weight from sixty-seven five pounds (60–75 lbs.). Many small communities have volunteer fire departments staffed in some instances by women, who find a tool of this size and weight very difficult to handle. High pressure hydraulic systems, of the order of five thousand pounds per sq. in. (5000 psi) are sometimes used in an effort to keep the weight down, but this introduces the disadvantage of operating outside of the power capabilities of a twelve volt (12 v) battery and requires the use of gasoline engines. Such engines are frequently difficult to start under the conditions of intermittent use most likely to be encountered and the engines of such systems may fail to start in highly critical emergencies when time is simply not available.

The above disadvantages and problems are overcome with the present tool in a manner not available in the known prior art.

SUMMARY OF THE INVENTION

The rescue tool has a self-contained prying and cutting feature and does not require separate components for use. It is sufficiently lightweight, of the order of half the weight of currently known tools, as to be truly portable and can be operated readily by one person. Further, the power requirements are substantially less than required with conventional systems. In addition, it is sufficiently inexpensive as to be affordable by small communities. The tool is adaptable for use with a twelve volt (12 v) battery or directly from a wrecker truck operating at two thousand five hundred pounds per sq. in. (2500 psi) and can even be used under water without short circuiting the electrical controls. It is also automatically turned off when not in immediate use.

The rescue tool includes a body; a first jaw member having an outer prying and clamping portion and an inner cutting portion; a second jaw member having an outer prying and clamping portion and an inner cutting portion, said second member being offset from said first member and at least partially overlapping said first member to perform the cutting action; and means connecting the first and second jaw members to the body for opening and closing said jaw members.

In one aspect the body includes an extensible arm and the connecting means connect the arm to the jaw members in pivotal relation.

In another aspect of the invention, the body includes a fluid operated cylinder and an extensible piston is mounted in the cylinder and the connecting means include pivot means connecting said first and second jaw members to the piston, and link means at each side of the pivot means connecting each of the jaw members to the body.

In yet another aspect of the invention, each jaw member includes a shearing portion disposed intermediate the prying portion and the cutting portion; in another aspect of the invention each jaw shearing portion and cutting portion includes arcuate edges intersecting to define overlappable points, and in another aspect of the invention the cutting portions are reentrantly arcuate to provide enclosing cutting edges.

In a further aspect of the invention, the jaw member prying portions are substantially thicker than the cutting portions.

In still another aspect of the invention, the body is generally cylindrical and includes a handle bar, extending circumferentially substantially three-fourths of the distance around the body, to provide handle portions on at least two sides of the body, and a cooperating guide handle is provided at one end of the body.

In yet another aspect of the invention, the body includes opposed pairs of spaced lugs and the link means includes opposed link members received between and pivotally connected to corresponding pairs of lugs, each link member including a hub portion and a pair of axially offset arm portions.

According to an aspect of the invention, the rescue tool can be used as part of a rescue system consisting of a power unit including a hydraulic reservoir; a twelve volt (12 v) electric motor having starter solenoids; and a twelve volt (12 v) power supply connected to the starter solenoids, providing a virtually self-contained power system for the tool.

In one aspect of the system, the switch means on the rescue tool includes a neutral "off" position and in another aspect of the system, the hydraulic connections on the tool are male and female to prevent inadvertent misconnection of the hydraulic lines from the reservoir to the tool.

DESCRIPTION OF THE PREFERRED EMBODIMENT

Figures 1, 2, 3:
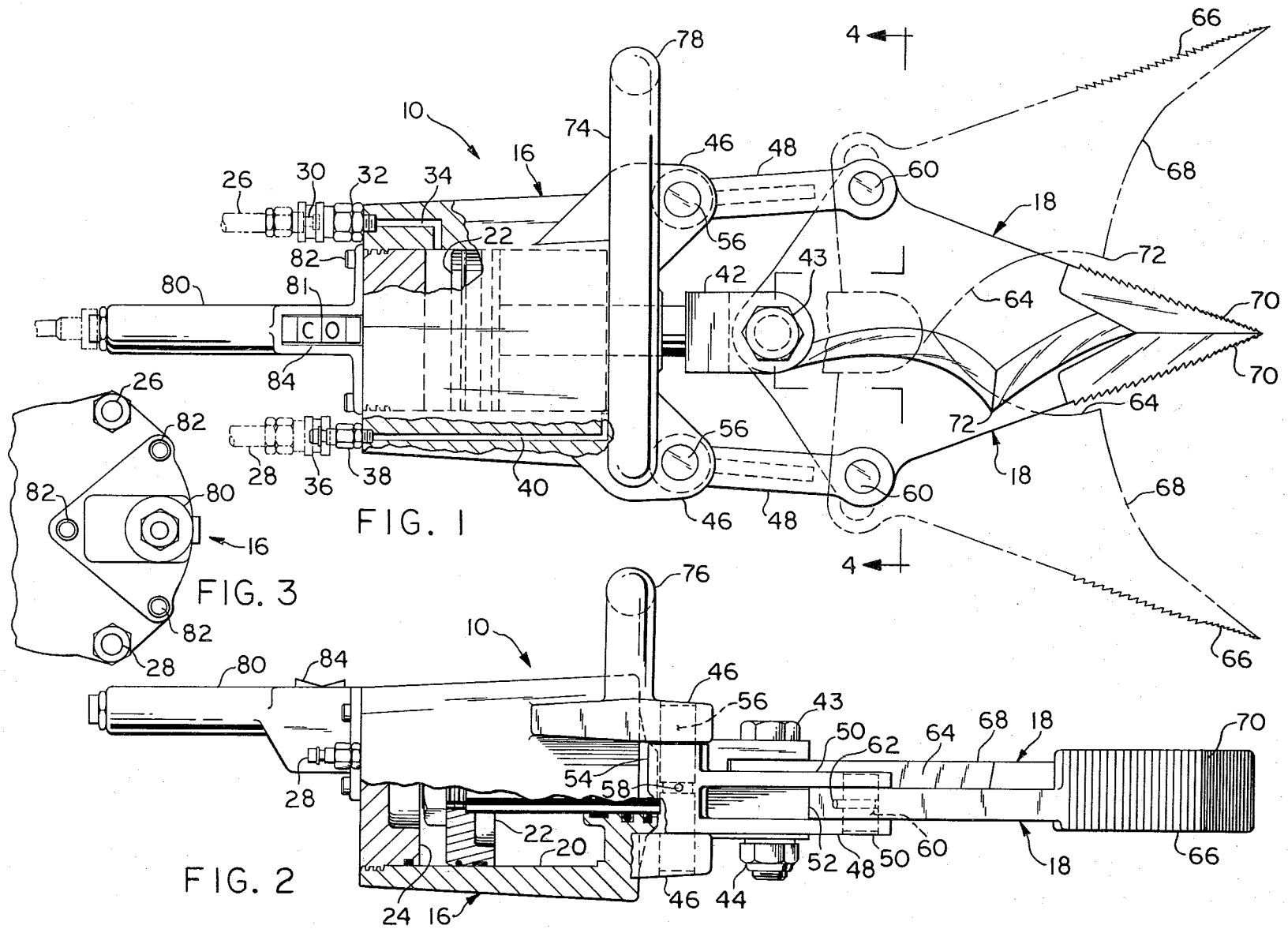
FIG. 1 is a plan view of the rescue tool, partly in cross-section, illustrating the jaws in the open and closed positions.
FIG. 2 is an elevational view of the rescue tool.
FIG. 3 is a fragmentary end view of the rescue tool.
Figure 9:
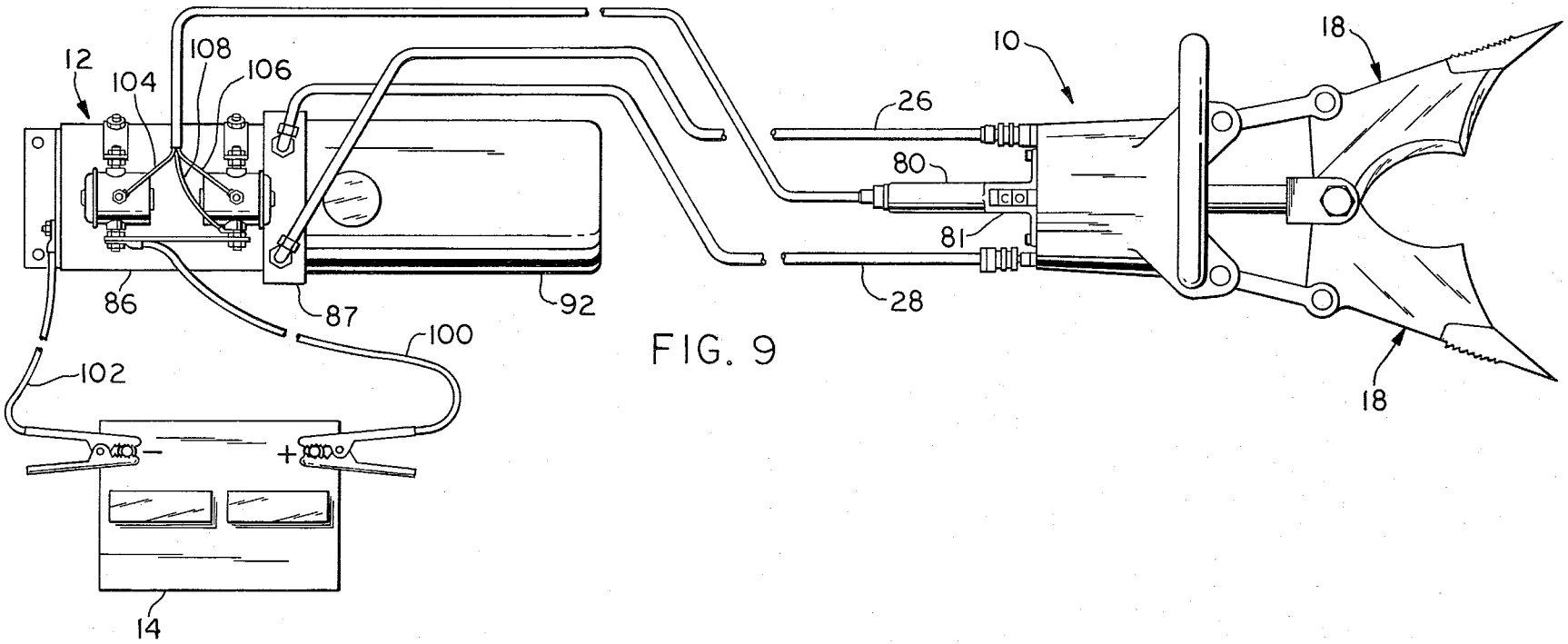
FIG. 9 is a view illustrating the rescue system.

Referring now by reference numerals to the drawings and first to FIGS. 1, 2 and 9 it will be understood that the rescue tool 10 shown is used in conjunction with a power unit 12 supplied with energy from a battery 14.

As best shown in FIGS. 1–4, the rescue tool itself consists essentially of a body 16 and a pair of identical jaw members 18 which are reversely attached to the body 16 in overlapping relation. The body 16 provides a hollow cylinder 20, having a threadedly attached cap 24, and housing a piston 22, constituting an outwardly extensible arm, mounted within the cylinder 20 and supplied with hydraulic fluid by hydraulic fluid lines 26 and 28 respectively. Fluid line 26 includes a quick-release male fitting 30 for connection to a corresponding female fitting 32 attached to the body 16, said fitting 32 communicating with the interior of the cylinder 20 at one side of the piston 22 by means of passage 34. The hydraulic line 28 includes a quick-release female fitting 36 for connection to a corresponding male fitting 38 attached to the body 16, said fitting 38 communicating with the interior of the cylinder 20 at the other side of said piston by means of passage 40.

Figure 4:
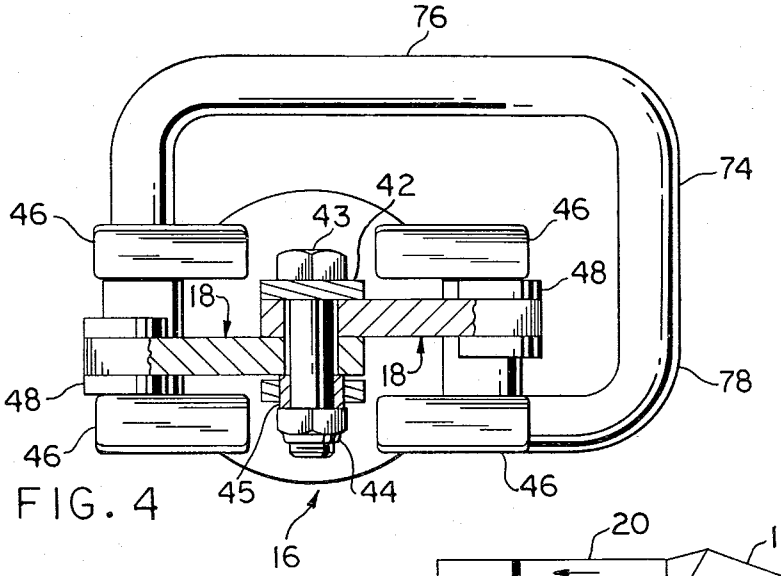
FIG. 4 is a cross-sectional view taken on line 4—4 of FIG. 1.

As will be clear from FIG. 4 the remote end of the piston 22 includes a U-shaped yoke 42 which is pivotally connected to the jaw members 18 by means of a pivot bolt 43 having an elastic locknut 44. A spacer 45 is provided between the nut 44 and the outside face of the adjacent jaw member 18 so that the jaw members 18 are clamped between the adjacent leg of the yoke 42 by tightening of the locknut 44 which facilitates acheiving the proper clamping pressure between the jaw members 18 without strain on the yoke 42.

The body 16 is provided with two pairs of opposed lugs 46 extending outwardly and forwardly of the body to provide pivotal connections between opposed link members 48, which extend between each jaw member 18 and the body 16, said link members 48 and said yoke 42 constituting means connecting the body 16 and the piston 22 to the jaw members 18. As best shown by reference to FIGS. 2 and 4, the link members 48 are substantially identical but are reversely connected. To this end each link member 48 includes a pair of arms 50 separated by a web 52 and is connected in offset relation to an integrally formed hub 54. Each hub 54 is connected between associated lugs 46 by means of a pivot pin 56, grooved intermediate its ends, to receive a set screw 58. The jaw members 18 are each received between the link member arms 50 and are attached thereto by means of a pivot pin 60, grooved intermediate its ends, to receive a set screw 62.

Figure 12:
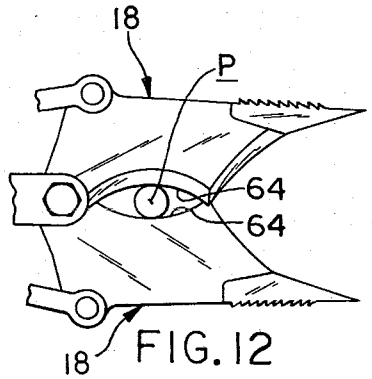
FIG. 12 is a similar view with the jaws in the cutting mode.
Figure 11:
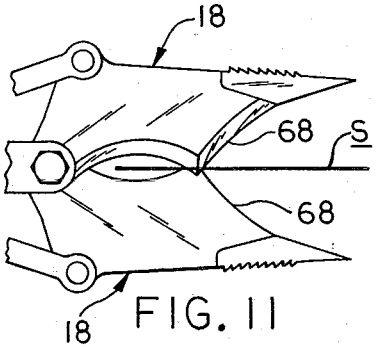
FIG. 11 is a similar view with the jaws in the metal shearing mode.
Figure 10:
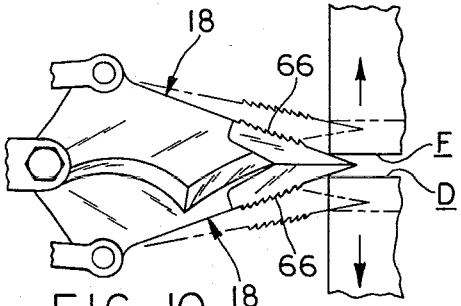
FIG. 10 is a diagrammatic showing the rescue tool as used with the jaws in the prying and spreading mode.

The jaw members 18 are substantially identical and each member includes an inner cutting portion 64, an outer prying and clamping portion 66 and an intermediate shearing portion 68. The cutting and shearing portions 64 and 68 are formed from substantially the same thickness of material and are disposed in overlapping relation to each other the edges being tapered at approximately forty-five degrees (45°). The prying portions 66 are thickened asymmetrically to provide an enlarged wedge-shaped end when the prying portions are closed, and said prying portions are provided on their outside face with serrations 70 to facilitate prying open a door D from its associated frame F as shown in FIG. 10. The configuration of the jaw members 18 is such that the cutting portions 64 and the shearing portions 68 are arcuately formed to define overlapping points 72. This configuration provides that the cutting portions 64, which are re-entrantly arcuate, initially diverging and then converging, can be used for cutting posts or the like as shown in FIG. 12. In effect, the overlapping of the points 72 an defines an enclosed cutting edge which prevents the post P from tending to slip away from engagement with the cutting edges. The shearing portions 68 on the other hand, as shown in FIG. 11, are configurated primarily to provide scissors action suitable for shearing metal parts S. As shown in FIG. 11 the points 72 can be used to facilitate this action by permitting the sheet metal S to be pierced so that it is held in position while shearing action by both the cutter portions 64 and the shearing portions 66 rearwardly and forwardly respectively proceeds.

The configuration of the prying and clamping portions 66 permits the tool 10 to be used in many different clamping operations and in particular to grip and tear sheet metal and to bend posts as desired.

As shown particularly in FIG. 4 the rescue tool 10 is provided with a handle bar 74 which is integrally formed with the end of one of the lugs 46 and the side of a diametrically opposite lug 46, such that the handle bar 74 extends circumferentially, substantially three-fourths of the distance around the body. By this structural arrangement of parts an upper handle portion 76 and an adjacent side handle portion 78 are provided. A guide handle 80, best shown in FIGS. 1 and 2 is mounted to the outer end of the body 16 as by fasteners 82 and cooperates with the handle bar 74 to provide a handle arrangement which permits the tool 10 to be held horizontally, vertically or angularly and either face-up or sideways.

Figure 5:
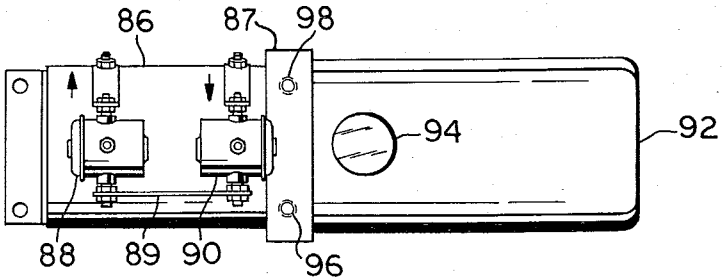
FIG. 5 is a plan view of a power unit used with the tool.
Figure 6:
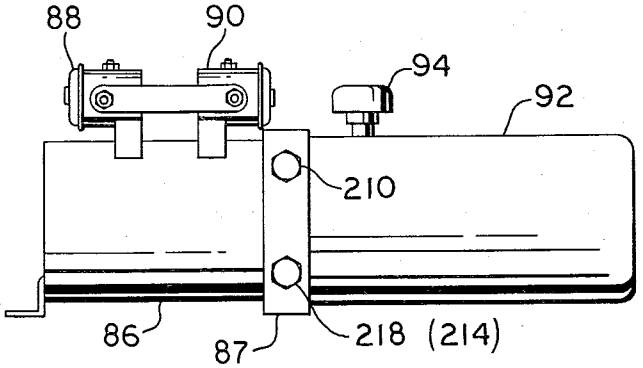
FIG. 6 is an elevational view thereof.

In the embodiment shown, the rescue tool 10 includes an electrical switch 81 which is built into the guide handle 80 and provides control for the open and closed positions of the jaw members 18. The switch 81 controls the action of the power unit 12, which, as shown in FIGS. 5, 6 and 9, includes a bi-directional motor 86 provided with starter solenoids 88 and 90 interconnected by conductor 89; pump and valve block and pump assembly 87 and a hydraulic reservoir 92 having a reservoir 94, and hydraulic connections 96 and 98 communicating with hydraulic lines 26 and 28 respectively to control the opening and closing of the jaw members 18.

In the arrangement shown in FIG. 1, the rocker 84 of the motor switch 81 includes an automatic, spring-centered neutral position during which neither the open (O) nor closed (C) side of the rocker 84 are depressed, this arrangement permitting the jaw members 18 to be maintained in any desired fixed or "frozen" position between the open and closed positions. This feature, by virtue of the connections between the electrical conductors 104 and 106 between the motor 86 and the starter solenoids respectively and the common conductor 108 also permits the tool to be effectively switched off, thus conserving power, when the tool 10 is not being used.

Figure 8:
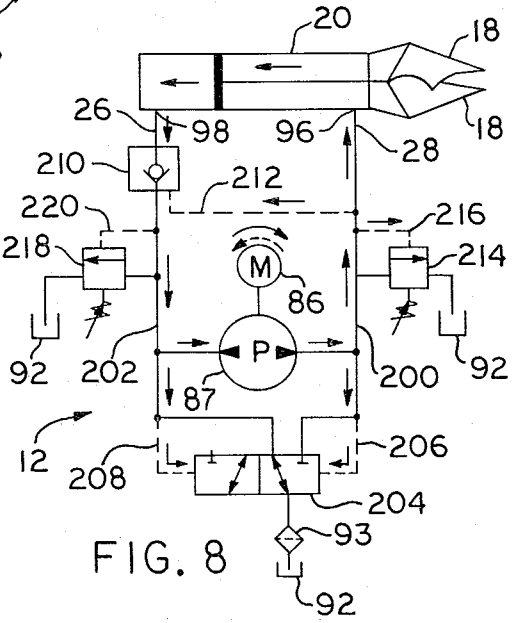
FIG. 8 is a diagrammatic view illustrating the hydraulic circuit of the power unit.
Figure 7:
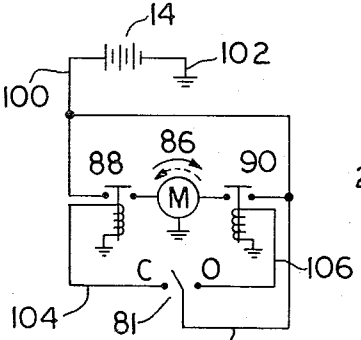
FIG. 7 is a diagrammatic view illustrating the electrical circuit of the power unit.

Referring now to the diagrammatic views of FIGS. 7 and 8 illustrating the electrical and hydraulic circuits respectively, it will be understood that upon moving the motor switch 81 into the jaw closed (C) position (FIG. 7), the starter solenoid 88 is closed and the bi-directional motor 86 rotates in a clockwise direction. When the motor rotation is clockwise, as shown in FIG. 8, fluid is supplied from the pump 87 under pressure to the rod end of the cylinder 20 via lines 200 and 28 resulting in the closing of the jaw members 18. The fluid forced out from the piston end of the cylinder 20 is directed back to the pump inlet via lines 26 and 202 thru check valve 210 which is held open by pilot line 212. The displacement from the piston end of the cylinder is greater than from the rod end because of differences in cross sectional area; therefore the flow out of the cylinder will exceed the pump requirements to pressurize the rod end. This excess flow is directed to the reservoir thru strainer 93 and valve 204 which is positioned by fluid pressure thru pilot line 206. When the end of the cylinder stroke is reached, the spring-loaded relief valve 214 is opened by virtue of pilot line 216 allowing pump flow to return to the reservoir 92.

When the motor switch 81 is moved to the neutral position, both starter solenoids are de-energized thus removing electrical power from the motor 86. This results in the freezing of the jaw members 18 in the position at the time of cutoff due to oil blockage on the piston end of the cylinder by check valve 210. This will permit a vehicle door to be held open, with the power unit turned off, while occupants are being removed.

When the motor switch 81 is moved into the jaw open (O) position (FIG. 7) the starter solenoid 90 is closed and the motor 86 rotates in a counter clockwise direction. When the motor direction is counter clockwise, fluid is supplied under pressure to the piston end of the cylinder 20 via lines 202 and 26 and forced from the rod end of the cylinder 20 via lines 28 and 200 resulting in the opening of the jaw members 18. In this mode, fluid pressure moves the valve 204 into the opposite position to that shown in FIG. 8 and flow thru the check valve 210 unimpeded. Because the pump inlet will require more fluid than that being forced from the cylinder, a negative pressure caused by the suction of the pump will draw oil from the reservoir thru strainer 93 to make up the difference in requirements. When the end of the stroke is reached, the spring-loaded relief valve 218 is opened by virtue of the pilot line 220 allowing fluid to flow to reservoir 92. In the embodiment shown the relief valves 214 and 218 are set at twenty-five hundred pounds per sq. in. (2500 psi).

The preferred embodiment described discloses the rescue tool 10 used in conjunction with a bi-directional hydraulic power unit 12. In effect, the switch 81 mounted to the rescue tool and the solenoids 88 mounted to the motor 86 and pump 87 combination provide a means of controlling the fluid supply from the reservoir 92 to the rescue tool. However, several alternative systems are possible using other fluid control means as shown schematically in FIGS. 13, 14 and 15.

Figures 13, 14, 15:
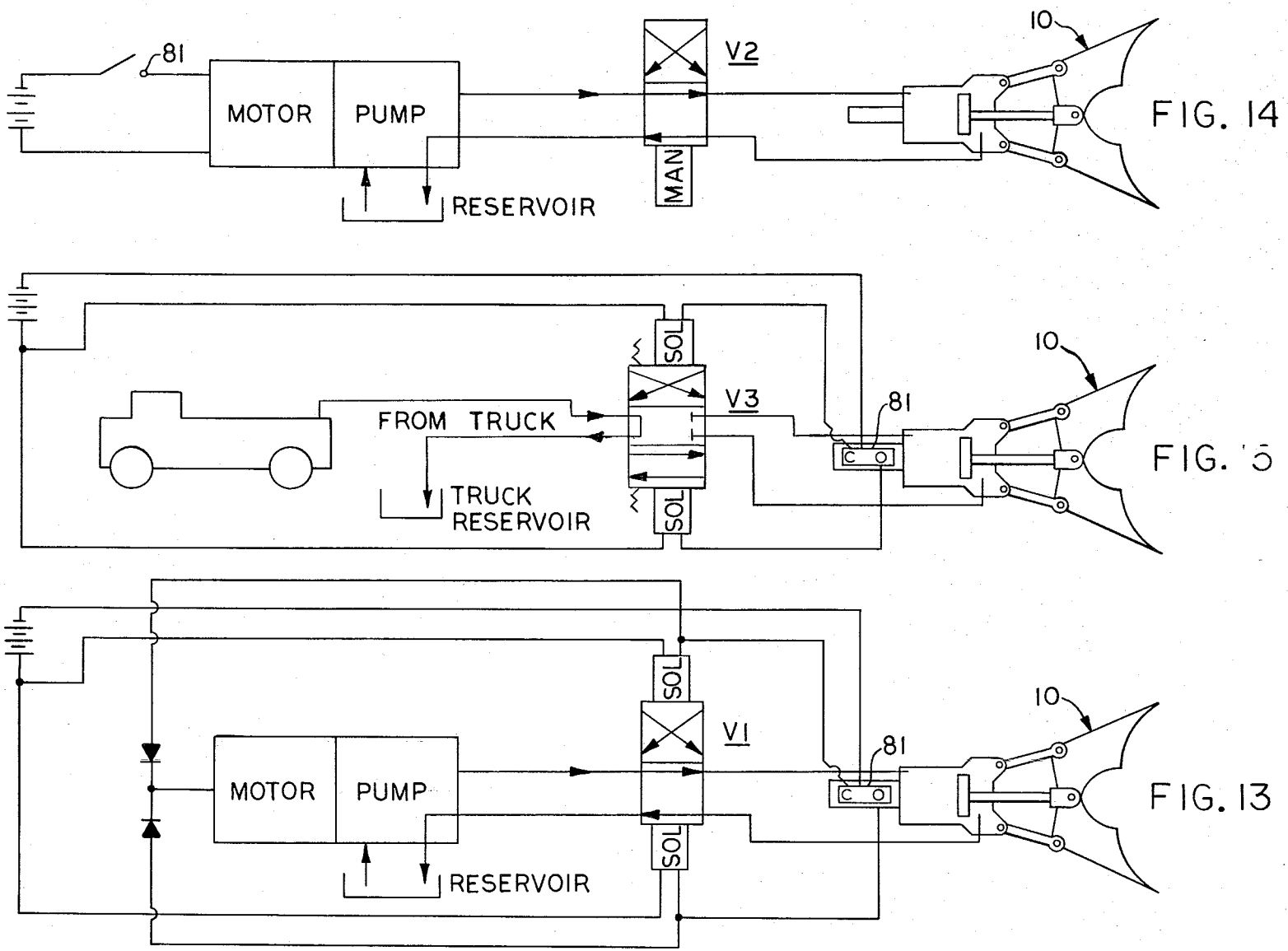
FIG. 13 is a schematic of an alternative rescue system.
FIG. 14 is a schematic of another alternative rescue system.
FIG. 15 is a schematic of another alternative rescue system.

As shown in FIG. 13, the power supply to the rescue tool 10 can also be provided by using a single direction motor and pump combination, and a fluid supply control means which includes a double-solenoid operated, four-way valve V1, in which case the control switch 81 in conjunction with diodes actuates the motor and one of the solenoids to switch the four-way valve.

It is also possible, as shown schematically in FIG. 14, to provide a fluid supply control means which includes a manual, four-way valve V2 mounted directly on the body 20 of the rescue tool with on-off switch 81' located on the power unit single direction, motor and pump combination.

One further alternative, as shown schematically in FIG. 15 is to use the rescue tool 10 in conjunction with the independent fluid supply source such as that provided by the reservoir and motor and pump combination of a wrecker truck. In this case, the fluid supply control means includes a spring-centered double-solenoid operated, three-position, four-way valve V3 mounted on the truck and the hydraulic supply of the truck is utilized by directly connecting it to the four-way valve. When the solenoids are de-energized the springs center the valve and flow from the truck is returned to the reservoir. The operation of the valve V3 is controlled with the same switch used to control the bi-directional motor and pump described in the preferred embodiment.

It is thought that the structural features and functional advantages of this portable rescue tool have become fully apparent from the foregoing description of parts but for completeness of disclosure the operation of the tool will be briefly described.

In the preferred embodiment, as shown in FIG. 9, the rescue tool 10 forms part of a rescue system which provides a power unit 12. The power unit 12 includes the bi-directional motor 86; pump 87, and reservoir 92. Power is supplied from the 12 v battery 14 through power cables 100 and 102.

The rescue tool 10 is particularly useful for freeing victims from automobile wreckage and will be discussed with reference to FIGS. 10, 11 and 12. In operation the rescuer approaches the automobile door D such as shown in FIG. 10 and with the jaw members 18 in the closed mode batters the joint between the automobile door D and the frame F in the vicinity of the door latch pin. In this mode the rescue tool 10 is used as a thirty-five pound sledge impacting a wedge and a few strikes opens the space between the door D and the frame F so that the closed jaw members 18 can be inserted therein. By depressing the rocker 84 of the switch 81 the jaw members 18 are opened a short distance of about one-half-one inch (½"–1"). The jaw members 18 are then closed again and repositioned into the enlarged opening and the procedure repeated, taking care not to open the jaws too wide at any one time as this would tend to cause the door to buckle making it harder to open. The procedure is repeated until the jaws 18 are opened wide enough so that the latch pin can be broken or the metal door D torn away from the latch pin. When this is achieved the door D can be opened and the occupants given first aid or removed as necessary. Depending on the condition of the automobile and operator proficiency the time will vary from three (3) seconds to ninety (90) seconds, an average time being twenty (20) seconds.

In the event that the steering wheel has the driver trapped, the jaws 18 are opened to encircle the peripheral rod P forming the wheel as shown in FIG. 12 and the jaw members 18 are closed to cut the wheel. Three cuts are usually sufficient to remove approximately half of the wheel and spoke and free the driver.

The jaw members 18, in the cutter mode, can also be used in those instances in which the car doors D are not accessible due to other wreckage or obstructions and in such instances the jaw members 18 are opened wide to encircle the post of the door D and the window frame along side the windshield (not shown). Closing the claw-like cutters severs this post. The same procedure can be used to cut the roof edge. Using the cutting portions 64, cuts can also be made into the roof edge about four inches deep above the rear part of the front door. When this has been repeated on opposite sides of the automobile and pressure applied, as by jumping on top of the roof in line with the two cuts above the door, a roof indentation constituting a bend line can be formed. At this stage the roof can easily be lifted off the windshield and be folded back along the bend line to free the occupants of the automobile from the top of the vehicle.

It will be understood that when it becomes necessary to shear the metal of the automobile, in particular cases, this can readily be achieved by using the shearing portions 68 for shearing sheet metal panels of the automobile as indicated in FIG. 11. If necessary, the entire roof can be removed by cutting all the supports. The tool can also be used to clamp and thereby fold back projecting parts such as posts and sheet metal.

The provision of the three-position rocker switch 80 to control the operation of the jaw members 18 facilitates operation of the rescue tool in all modes. In the prying mode, the prying portions 66, by virtue of being located in front of the cutting portions 64 do not hinder the cutting operation. Likewise, the location of the cutting portions behind the prying portions does not hinder the wedging, prying or clamping operation.

The points 72 between the cutting portions 64 and the shearing portions 68 assist in the cutting action by permitting the piercing of sheet metal such as a roof, tending to hold the jaw members 18 in place while completing the cutting action.

It has been found that the cutting action requires more than twice the force of the prying or spreading action. The average cutting center of the encircling cutting portions 64 as defined approximately by the center of the post P in FIG. 12 is less than one-half of the distance from the pivot 44 to the remote end of the prying portions 66 and this structural arrangement of parts compensates for the variation in power requirements between prying and cutting. The cutting portions 64 and shearing portions 68 are provided with tapered blade edges which tends to prevent the edges from spreading apart during the cutting action because of the force component of the sideways cutting force which tends to urge the edges together, such component being approximately equivalent to the cutting force because of the forty-five degree (45°) angle of the cutting edge.

The structural arrangement of parts of the tool 10 is such that it can be made considerably lighter than is customary and the combination of the circumferential handle 74 and the guide handle 80 permits the tool to be used horizontally facing upwardly or sideways, as well as vertically and virtually all angular positions between.

I claim as my invention:

1. A tool for rescue work comprising:

(a) a body, (b) a first jaw member having an outer prying and clamping portion and an inner cutting portion, (c) a second jaw member having an outer prying and clamping portion and an inner cutting portion, said second member being offset from said first member and at least partially overlapping said first member to provide the cutting action, and (d) means connecting said first and second jaw members to the body for opening and closing said jaw members, the cutting portion of the jaw members and the prying and clamping portion of the jaw members being operatively disposed on the same side of the connection means and said outer prying and clamping portions of the jaw members being interengageable in the closed position to facilitate the clamping and prying action and to facilitate use as a wedge.

2. A tool for rescue work as defined in claim 1, in which:

(e) an extensible arm is mounted to the body, and (f) the connecting means connect the extensible arm to the jaw members and include pivot means connecting the overlapping jaw members to each other in pivotal relation at the same pivot axis to permit the outer prying and clamping portions to close.

3. A tool for rescue work as defined in claim 1, in which:

(e) each jaw member includes an overlappable point disposed inwardly of the prying and clamping portion.

4. A tool for rescue work comprising:

(a) a body, (b) a first jaw member having an outer prying and clamping portion and an inner cutting portion, (c) a second jaw member having an outer prying and clamping portion and an inner cutting portion, said second member being offset from said first member and at least partially overlapping said first member to provide the cutting action, (d) means connecting said first and second jaw members to the body for opening and closing said jaw members, the cutting portion of the jaw members and the prying and clamping portion of the jaw members being operatively disposed on the same side of the connection means, (e) each jaw member including a shearing portion disposed intermediate the prying and clamping portion and the cutting portion, and (f) each jaw member shearing portion and cutting portion including an arcuate edge, said arcuate edges intersecting to define overlappable points.

5. A tool for rescue work comprising:

(a) a body, (b) a first jaw member having an outer prying and clamping portion and an inner cutting portion, (c) a second jaw member having an outer prying and clamping portion and an inner cutting portion, said second member being offset from said first member and at least partially overlapping said first member to provide the cutting action, (d) means connecting said first and second jaw members to the body for opening and closing said jaw members, the cutting portion of the jaw members and the prying and clamping portion of the jaw members being operatively disposed on the same side of the connection means, (e) the body including a fluid operated cylinder and an extensible piston mounted in the cylinder, and (f) the connecting means including pivot means connecting said first and second overlapping jaw members to the piston at the same pivot axis, and link means at each side of the pivot means connecting each of the jaw members to the body.

6. A tool for rescue work as defined in claim 5, in which:

(g) the body includes a plurality of lugs, and (h) the link means are pivotally connected to said lugs at one end of said link means.

7. A tool for rescue work as defined in claim 5, in which:

(g) the body includes opposed pairs of spaced lugs, and (h) the link means includes opposed link members received between and pivotally connected to corresponding pairs of lugs.

8. A tool for rescue work as defined in claim 7, in which:

(i) each link member includes a hub portion and a pair of axially offset arm portions the link members being substantially identical but reversely attached to the body.

9. A tool for rescue work as defined in claim 5, in which:

(g) the piston includes a yoke at the remote end having opposed openings, and (h) the pivot means connecting the first and second jaw members to the piston include:

1. a fastener extending through said yoke openings, and
2. a spacer carried by the fastener and received within one of said openings to operatively bear against said fastener and one of said jaw members.

10. A tool for rescue work comprising:

(a) a body, (b) a first jaw member having an outer prying and clamping portion and an inner cutting portion, (c) a second jaw member having an outer prying and clamping portion and an inner cutting portion, said second member being offset from said first member and at least partially overlapping said first member to provide the cutting action, (d) means connecting said first and second jaw members to the body for opening and closing said jaw members, the cutting portion of the jaw members and the prying and clamping portion of the jaw members being operatively disposed on the same side of the connection means, (e) each jaw member cutting portion being reentrantly formed to provide enclosing cutting edges.

11. A rescue tool as defined in claim 10, in which:

(f) the average center of the enclosing cutting portions is spaced from the pivot means connecting the first and second jaw members less than one-half of the distance from said pivot means to the remote end of the prying portions.

12. A tool for rescue work comprising:

(a) a body, (b) a first jaw member having an outer prying and clamping portion and an inner cutting portion, (c) a second jaw member having an outer prying and clamping portion and an inner cutting portion, said second member being offset from said first member and at least partially overlapping said first member to provide the cutting action, (d) means connecting said first and second jaw members to the body for opening and closing said jaw members, the cutting portion of the jaw members and the prying and clamping portion of the jaw members being operatively disposed on the same side of the connection means, (e) the jaw member cutting portions in the jaw open condition initially diverging from each other and then converging toward each other as the distance from the connection means is increased.

13. A tool for rescue work comprising:

(a) a body, (b) a first jaw member having an outer prying and clamping portion and an inner cutting portion, (c) a second jaw member having an outer prying and clamping portion and an inner cutting portion, said second member being offset from said first member and at least partially overlapping said first member to provide the cutting action, (d) means connecting said first and second jaw members to the body for opening and closing said jaw members, the cutting portion of the jaw members and the prying and clamping portion of the jaw members being operatively disposed on the same side of the connection means, (e) each jaw member prying and clamping portion being asymmetrically formed and being substantially thicker than the corresponding cutting portion.

14. A tool for rescue work as defined in claim 13, in which:

(f) each jaw member prying and clamping portion is substantially twice as thick as the cutting portion.

15. A tool for rescue work comprising:

(a) a body, (b) a first jaw member having an outer prying and clamping portion and an inner cutting portion, (c) a second jaw member having an outer prying and clamping portion and an inner cutting portion, said second member being offset from said first member and at least partially overlapping said first member to provide the cutting action, (d) means connecting said first and second jaw members to the body for opening and closing said jaw members, the cutting portion of the jaw members and the prying and clamping portion of the jaw members being operatively disposed on the same side of the connection means, (e) the body including adjacent and side faces and a handle bar extending at least partially around the body to provide handle portions on at least two adjacent faces of the body and a single cooperating guide handle at one end of the body.

16. A rescue system comprising:

(a) a rescue tool including:

1. a body including a fluid-operated cylinder, an extensible arm means being mounted in the cylinder,
2. a first jaw member having an outer prying and clamping portion and an inner cutting portion,
3. a second jaw member having an outer prying and clamping portion and an inner cutting portion, said second member being off-set from said first member and at least partially overlapping said first member to perform the cutting action and said outer prying and clamping portions of the jaw members being interengageable in the closed position to facilitate the clamping and prying action and to facilitate use as a wedge, and
4. means operatively connecting said first and second jaw members to the body and the arm means for opening and closing said jaw members, the cutting portion of the jaw members being operatively disposed on the same side of the connection means, and (b) a power supply including:

1. a fluid reservoir,
2. motor and pump means, and
3. means controlling the fluid supply from the fluid reservoir to the rescue tool cylinder to control movement of the jaw members between open and closed conditions.

17. A rescue system as defined in claim 16, in which:

(c) the motor and pump means include a single direction motor, and (d) the fluid supply control means includes a double-solenoid operated, four-way valve and electrical switch means for the motor and the solenoids.

18. A rescue system as defined in claim 16 in which:

(c) the motor and pump means include a single direction motor, and (d) the fluid supply control means includes a manual four-way fluid valve mounted to the body of the rescue tool.

19. A rescue system as defined in claim 16, in which:

(c) the fluid reservoir and the motor and pump means are provided by a wrecker truck, and (d) the fluid supply control means includes a three-position, double-solenoid operated, four-way valve mounted on truck and switch means for the valve mounted to the rescue tool.

20. A rescue system comprising:

(a) a rescue tool including:

1. a body including a fluid-operated cylinder, an extensible arm means being mounted in the cylinder,
2. a first jaw member having an outer prying and clamping portion and an inner cutting portion,
3. a second jaw member having an outer prying and clamping portion and an inner cutting portion, said second member being off-set from said first member and at least partially overlapping said first member to perform the cutting action, and
4. means operatively connecting said first and second jaw members to the body and the arm means for opening and closing said jaw members, the cutting portion of the jaw members and the prying and clamping portion of the jaw members being operatively disposed on the same side of the connection means, and (b) a power supply including:

1. a fluid reservoir,
2. motor and pump means, and
3. means controlling the fluid supply from the fluid reservoir to the rescue tool cylinder to control movement of the jaw members between open and closed conditions, (c) the motor and pump means including an electrical, bi-directional motor, and (d) the fluid supply control means including a pair of starter solenoids mounted to the motor and pump means, and switch means for the starter solenoids mounted to the rescue tool.

21. A rescue system as defined in claim 20, in which:

(e) the electrical switch means includes an automatic neutral "off" position.

22. A rescue system as defined in claim 21, in which:

(e) hydraulic line means are connected between the reservoir and the cylinder including quick-release connections to the cylinder.

* * * * *